US009981399B2

(12) United States Patent
Foster et al.

(10) Patent No.: US 9,981,399 B2
(45) Date of Patent: May 29, 2018

(54) DEVICE AND METHOD FOR CUTTING INSULATION

(71) Applicant: Vicon Machinery, LLC, Pevely, MO (US)

(72) Inventors: Dale Foster, Barnhart, MO (US); Mike Fischer, Festus, MO (US)

(73) Assignee: Vicon Machinery, LLC, Pevely, MO (US)

( * ) Notice: Subject to any disclaimer, the term of this patent is extended or adjusted under 35 U.S.C. 154(b) by 234 days.

(21) Appl. No.: 14/152,239

(22) Filed: Jan. 10, 2014

(65) Prior Publication Data

US 2014/0196586 A1 Jul. 17, 2014

Related U.S. Application Data

(60) Provisional application No. 61/751,624, filed on Jan. 11, 2013.

(51) Int. Cl.

| | |
|---|---|
| ***B26D 7/32*** | (2006.01) |
| ***B26D 1/18*** | (2006.01) |
| ***B26D 5/00*** | (2006.01) |
| ***B26D 7/06*** | (2006.01) |

(52) U.S. Cl.

CPC ..... *B26D 7/32* (2013.01); *B26D 1/18* (2013.01); *B26D 5/00* (2013.01); *B26D 7/0625* (2013.01); *Y10T 83/0448* (2015.04); *Y10T 83/162* (2015.04)

(58) Field of Classification Search

CPC ..... B26D 7/32; B26D 7/0625; B26D 5/00; B26D 7/27; B26D 7/322; B26D 5/20; B26D 5/22; B26D 5/28; B26D 5/38

USPC ..... 83/13, 23, 258, 283

See application file for complete search history.

(56) References Cited

U.S. PATENT DOCUMENTS 3,615,994 A * 10/1971 MacLaine ..... B29C 65/5042 156/159
3,819,448 A * 6/1974 Beever, III ..... B26D 1/04 156/355
4,038,128 A * 7/1977 Mueller ..... B26D 1/605 156/355
4,043,232 A * 8/1977 Jovin ..... A44B 19/42 83/13
4,396,454 A * 8/1983 Brys ..... B32B 37/1284 156/324
4,619,635 A * 10/1986 Ottaviano ..... B31D 5/0047 493/36

(Continued)

OTHER PUBLICATIONS

"Building insulation," http://en.wikipedia.org/wiki/Building_insulation, printed on Dec. 13, 2012, 7 pages.

(Continued)

*Primary Examiner* — Jason Daniel Prone
*Assistant Examiner* — Richard Crosby, Jr.
(74) *Attorney, Agent, or Firm* — Lewis Rice LLC

(57) ABSTRACT

An insulation cutter for a liner application machine in an assembly line and method of operation that cuts an insulative thermal blanket by stopping the liner application machine momentarily to allow for a rotary cutter to traverse the width of the belt (and the width of the thermal insulation blanket) and potentially return back to its original position. The machine is then restarted and allowed to continue to feed.

5 Claims, 3 Drawing Sheets

(56) References Cited

U.S. PATENT DOCUMENTS

| | | | | | |
|---|---|---|---|---|---|
| 5,046,392 | A * | 9/1991 | Keon | B26D 1/18 | 83/455 |
| 5,315,906 | A * | 5/1994 | Ferenczi | B23D 45/024 | 83/151 |
| 5,458,034 | A * | 10/1995 | Cavagna | B26D 1/185 | 83/488 |
| 5,850,984 | A * | 12/1998 | Kleitz | B65H 16/021 | 242/555.5 |
| 5,904,084 | A * | 5/1999 | Weston | B26D 7/025 | 83/373 |
| 6,095,454 | A * | 8/2000 | Simmons, Jr. | B31D 5/0047 | 242/559 |
| 6,394,384 | B1 * | 5/2002 | Alday | B65H 19/126 | 242/559.2 |
| 6,681,669 | B1 * | 1/2004 | Bogan | B26D 1/18 | 83/176 |
| 6,694,852 | B1 * | 2/2004 | Ours | B65B 69/0033 | 414/412 |
| 6,813,985 | B2 * | 11/2004 | Gharst | B26D 1/18 | 242/557 |
| 7,926,757 | B2 * | 4/2011 | Fischer | B65H 16/06 | 242/559.2 |
| 7,975,583 | B2 * | 7/2011 | Schmid | B26D 5/34 | 83/241 |
| 8,132,488 | B2 * | 3/2012 | Kaneko | G03G 15/6582 | 83/155 |
| 8,155,778 | B1 * | 4/2012 | Barcock | F24F 13/0245 | 700/172 |
| 8,506,736 | B1 * | 8/2013 | Pienta | B23C 3/007 | 156/153 |
| 8,561,272 | B2 * | 10/2013 | Borwig | B26D 1/08 | 29/33 Q |
| 8,640,581 | B2 * | 2/2014 | Weissenberger | B26D 7/2628 | 83/34 |
| 2001/0003939 | A1 * | 6/2001 | Liu | B26D 1/18 | 83/800 |
| 2001/0033782 | A1 | 10/2001 | Conley | | |
| 2004/0143954 | A1 | 7/2004 | Walsh | | |
| 2011/0174128 | A1 * | 7/2011 | Kroskey | B21D 5/08 | 83/76.9 |
| 2012/0186316 | A1 | 7/2012 | Baker et al. | | |
| 2013/0039686 | A1 * | 2/2013 | Yazawa | B26D 1/085 | 400/621 |
| 2013/0139665 | A1 * | 6/2013 | Sperry | B26D 7/32 | 83/77 |
| 2014/0109739 | A1 * | 4/2014 | Schneider | B26D 1/405 | 83/27 |

OTHER PUBLICATIONS

"Duct (HVAC)," http://en.wikipedia.org/wiki/Duct_(HVAC), printed on Dec. 14, 2012, 6 pages.
"Duct Sealing", U.S. Environmental Protection Agency, 430F-09-050, Feb. 2009, 5 pages.
"Duct insulation," http://www.insulation4less.com/Insulation4lessTechnicalArticles-35-Duct-Insulation.aspx, printed on Dec. 14, 2012, 4 pages.
"Duct Sealing," http://www.energystar.gov/index.cfm?c=home_improvement.hm_improvement_ducts, printed on Dec. 14, 2012, 1 page.
"Ductmate: PolyArmor Tools", http://www.ductmate.com/product.aspx?id=146, printed on Dec. 13, 2012, 2 pages.
"Ductmate: PolyArmor Tools", http://www.ductmate.com/product.aspx?id=149, printed on Dec. 13, 2012, 2 pages.
"Insulated Duct Cleaning and Maintenance," http://www.naima.org/insulation-knowledge-base/duct-hvac-insulation/insulated-duct-cleaning-and-maintenance.html, printed on Dec. 13, 2012, 3 pages.
"Duct Sealing and Insulation," http://www.energysavvy.com/topics/duct-sealing-and-insulation/, printed on Dec. 13, 2012, 4 pages.
"DIY: How to Insulate Ductwork," http://voices.yahoo.com/diy-insulate-ductwork-4650291.html, printed on Dec. 13, 2012, 3 pages.
"Ductmate Poly Armor Polyester Duct Liner," Ductmate Green Products, Issue 652, May 2012, www.ductmate.com, 4 pages.
Eastman Cardinal 534 Round Knife Cutting Machine, https://www.rfsupply.com/product/21, printed on Dec. 13, 2012, 5 pages.
Material Safety Data Sheet for Poly Armor, Ductmate Industries, Inc., Issued on Mar. 19, 2012, 2 pages.
"Little Giant," Eastman Machine Co., http://www.eastmancuts.com/little-giant, printed on Dec. 14, 2012, 2 pages.
"HVAC Cutting Systems," Plasma Automation Inc., Vicon Machinery LLC, www.plasma-automation.com, 15 pages.
"Plasma cutting," http://en.wikipedia.org/wiki/Plasma_cutting, printed on Dec. 19, 2012, 3 pages.
"Laser cutting," http://web.archive.org/web/20121115035544/http://en.wikipedia.org/wiki/Laser_cutting, printed on Dec. 9, 2014, 9 pages.
Iowa Precision Digital Pattern Entry System, "Pyrodraw: For easy programming of patterns into IPI's Pyromatic Plasma Continuous Cutting System," Iowa Precision Coiled Metal Processing Systems Worldwide, 1 page.
"HVAC Rollforming and Sheet Metal Equipment," Vicon Machinery LLC, www.viconmachinery.com, 16 pages.
"Coil Line Duct Processing Systems," Vicon Machinery LLC, www.viconmachinery.com, 14 pages.
"HVAC Cutting Systems," Plasma Automation Inc., Vicon, www.plasma-automation.com, 12 pages.

* cited by examiner

DEVICE AND METHOD FOR CUTTING INSULATION

CROSS REFERENCE TO RELATED APPLICATION(S)

This application claims benefit of U.S. Provisional Application Ser. No. 61/751,624 filed Jan. 11, 2013, the entire disclosure of which is herein incorporated by reference.

BACKGROUND OF THE INVENTION

1. Field of the Invention

This disclosure is related to the field of insulation cutting machines. More specifically, the present disclosure relates to devices, methods and processes for cutting insulation such as cutting insulation for ductwork consisting of thick fiber on various types of backing including reflective aluminum backing.

2. Description of the Related Art

Thermal insulation is an important component in achieving thermal comfort for the occupants of building structures. Specifically, insulation reduces unwanted heat loss or gain, can decrease the energy demands of heating and cooling systems and can increase sound attenuation.

Insulation is often utilized in ductwork to increase the comfort, energy efficiency and sound attenuation of forced-air heating and cooling systems. In building structures with forced-air heating and cooling systems, ducts are used to distribute air throughout the structure. Stated differently, air ducts are the throughways through which treated air from heating or conditioning equipment in forced-air systems is distributed throughout the building structure.

Air ductwork is usually constructed out of thin metal sheets that, due to their physical construction and properties, easily conduct heat. Generally, air ducts lose heat in three main ways: first by conduction of heat through contact of the material with the surrounding air; second by radiation; and third by leaking through the cracks and seams of the air duct system. In fact, according to the United States Department of Energy, due to extreme winter and summer temperatures present in unconditioned spaces where ducts travel, about 10 to 30 percent of the energy used to heat and cool air is lost through conduction through duct surfaces.

It is well known that this energy loss in ductwork systems can be mitigated through the use of insulation—good duct insulation will improve the energy efficiency of insulated forced-air systems. When utilized, insulation has the ability to save money by increasing the efficiency of heating and cooling systems by as much as twenty (20) percent.

The insulation that is utilized for ductwork systems is generally comprised of materials used to reduce heat transfer by conduction, radiation or convection in varying combinations to achieve the desired outcome; i.e., thermal comfort with reduced energy consumption. One type of insulation commonly used in air ducts is thermal batting (batts) or blankets. This type of insulation is generally available in large, continuous rolls. Notably, compression or matting of the material which comprises the blanket impairs its functionality. Common materials utilized to create thermal blankets include, but are not limited to: rock and slag wool (usually made from rock (basalt, diabase) or iron ore); fiberglass (made from molten glass, usually with 20% to 30% recycled industrial waste and post-consumer content); high-density fiberglass; plastic fiber; polyester fiber; and elastomeric materials. Generally, thermal blankets comprised of elastomeric foam and plastic fiber have numerous beneficial thermal properties over insulation comprised of fiberglass. In addition, these types of insulation are not as abrasive as fiberglass-based thermal blankets. However, due to their high density and fibrous content, these forms of insulation are notoriously hard to cut and handle.

Often, many insulative thermal blankets further include a thermally reflective surface called a radiant barrier. This material is added to the thermal blanket to reduce the transfer of heat through radiation as well as conduction. When a radiant barrier, such as aluminum sheet or another commonly utilized reflective substance, is utilized it creates a reflective insulation product that is able to control conductive heat transfer, radiant heat transfer, and condensation all in one product.

While beneficial from a thermodynamic standpoint, this thermally reflective surface can add complexity to the cutting of the thermal blanket—it makes it harder to get a clean and precise cut. For example, new thermally beneficial insulative thermal blankets such as PolyArmor® by Ductmate (a polyester duct liner—fiberglass free—with a radiant layer backing) can be notoriously difficult to cut and manage.

Despite the fact that the use of insulation has become ubiquitous in the ductwork industry, the methodologies for cutting insulation for ductwork have remained old-school, outdated and rudimentary. A large majority of insulation is still cut manually and by hand using box cutters, utility knives, round knives and/or passive rotary blades (i.e., non-powered rotary blades or "pizza cutters") with a guide for the respective outline of the size of insulation desired. In this conventional methodology, a worker rolls out the thermal blanket, places a cutting guide over the thermal blanket that corresponds with the desired shape of the thermal insulation to be cut, and utilizes a box cutter, passive rotary blade or other known non-powered blade mechanism to cut around the guide to cut out the desired shape from the thermal blanket. In this process, the cutting mechanism often fails to make a clean cut through the thermal blanket. Further, the radiant layer is also often improperly cut or torn in this procedure.

This conventional manual method for cutting insulation is problematic on a number of levels: it is high in cost, requires manual labor, is inefficient, ruins the product (as noted previously, it often chops the product off), and results in a very imprecise cut. In addition, as fiberglass is very abrasive, the thermal blanket can quickly wear down the blade of the cutting apparatus utilized, resulting in this equipment having to be changed often (and thus further adding to the cost of the procedure). In sum, the conventional method for manually cutting thermal blankets for rectangular air duct and fittings is a time and money waster. This is especially true now that, in many markets, thermal blanket insulation costs more than the sheet metal to which it is attached.

While some alternatives to manual insulation cutting have emerged in the market, these methodologies are still insufficient for a number of reasons. Water jet cutting, while providing precision and accuracy in cutting, still lacks the efficiency and speed required to utilize it as a cutting methodology on an automated assembly line. Further, water jet cutting still includes a manual component—the pieces, once cut, are removed from the thermal blanket by hand. This manual removal exposes the pieces to tearing, compression and other manual damage.

Another mechanized method of insulation cutting currently utilized in the art is the chop method. In this method a long knife blade is utilized in an assembly line in a guillotine-like fashion—when released it cuts the insulation blanket via a chopping methodology. Yet another newly-utilized method for cutting ductwork insulation is the swing blade method. Similar to the chop method, in this method a long knife blade is utilized on an assembly line. In this method, the serrated long knife blade is released and slices through the thermal insulation. Generally, in this method, the knife blade is affixed to two pivoting brackets that allow the knife to swing down while remaining parallel with the thermal insulation and chopping through in a swinging motion quite similar to the chopping methodology, but allowing for some side-to side cutting action.

Notably, both the chop and the swing blade methods are utilized on ductwork assembly lines. These assembly lines, as will be discussed further in this application, generally function as follows. Pieces of cut metal ductwork that correspond to particular sections of the ductwork structure to be assembled travel down a belt in the assembly line. In addition to the continuous stream of cut metal ductwork pieces, a continuous stream of thermal insulative blanket, which will be adhered to the precut metal ductwork, also travels down the assembly line. Generally, the thermal insulative blanket is adhered to the precut metal ductwork by glue or similar adhesive and nails (called pins) (or similar fastening methodology). This adhesion of the sheet metal and insulative blanket to each other generally occurs in a continuous manner.

This continuous stream of insulative blanket and precut sheet metal generally requires uninterrupted cutting of the thermal insulative blanket so that the merger and adhesion of the two pieces (sheet metal and insulation) will not be impermissibly altered. Thus, quick automated technologies, such as the chop and swing blade method, are utilized so that a cut can be accomplished without interrupting the continuous stream of component parts down the assembly line. That is, the flow is not stopped for the cutting action. Thus, the cutting action is generally very quick and is along all the points of cutting at once so that a straight, and not angled, cut is made. The problem with both of these automated technologies however is the motion is often not sufficient to cut through elastomeric thermal insulation blankets that are further comprised of a layer of radiant material because of the extra resistance it provides.

Accordingly, there is a need in the art for an insulation cutting mechanism that can be utilized in an automated production line that is able to properly cut-through all types of thermal insulation blankets (including elastomeric-based thermal blankets with a reflective layer) without damaging the insulation in the cutting process

SUMMARY OF THE INVENTION

The following is a summary of the invention, which should provide to the reader a basic understanding of some aspects of the invention. This summary is not intended to identify critical elements of the invention or in any way to delineate the scope of the invention. The sole purpose of this summary is to present in simplified text some aspects of the invention as a prelude to the more detailed description presented below.

Described herein, among other things, is a liner application machine for attaching an insulative thermal blanket to a piece of metal ductwork, the machine comprising: a frame; a conveyor belt carrying an insulative thermal blanket; a shear assembly located on the frame, the shear assembly including; a cutting mechanism including a motorized rotary blade which is configured to traverse a path across the conveyor belt; and a stopping mechanism, located at a terminal end of the path, the stopping mechanism detecting if the cutting mechanism is present at the terminal end; and a computer controller configured to control a cutting event and configured to control the conveyor belt; wherein, when a cutting event occurs: the controller first stops the conveyor belt; secondly, the cutting mechanism traverses the path until the stopping mechanism detects the cutting mechanism; and thirdly, the controller restarts the conveyor belt.

In an embodiment of the machine, the shear assembly further comprises a second stopping mechanism located at a second terminal end of the path.

In an embodiment of the machine, the path comprises the cutting mechanism crossing the conveyor belt only a single time.

In an embodiment of the machine, the path comprises the cutting mechanism crossing the conveyor belt multiple times which may comprise crossing once in a first direction and once in a reverse direction.

In an embodiment, the machine further comprises a drive roller for the conveyor belt and the cutting event occurs prior to the drive roller.

There is also described herein, a method for cutting an insulative thermal blanket during assembly of lined ductwork, the method comprising: providing a liner application machine for joining an insulative thermal blanket to a piece of metal ductwork, the machine including: a shear assembly located on the frame, the shear assembly including; a cutting mechanism including a motorized rotary blade which is configured to traverse a path across the conveyor belt; a stopping mechanism, located at a terminal end of the path, the stopping mechanism detecting if the cutting mechanism is present at the terminal end; and a computer controller; the computer controller stopping motion of the insulative thermal blanket through the liner application machine; after the motion is stopped, cutting the insulative thermal blanket with the cutting mechanism; and after the insulative thermal blanket is cut, the computer controller restarting motion of the insulative thermal blanket through the liner application machine.

In an embodiment of the method: when the computer controller stops motion of the insulative thermal blanket through the liner application machine, the computer controller also stops motion of the piece of metal ductwork through the liner application machine; and when the computer controller restarts motion of the insulative thermal blanket through the liner application machine, the computer controller also restarts motion of the piece of metal ductwork through the liner application machine.

In an embodiment of the method, the cutting of the insulative thermal blanket with the cutting mechanism comprises: the cutting mechanism crossing the conveyor belt only a single time.

In an embodiment of the method, the cutting of the insulative thermal blanket with the cutting mechanism comprises: the cutting mechanism crossing the conveyor belt multiple times, which may comprise crossing once in a first direction and once in a reverse direction.

There is also described herein, a shear assembly for a liner application machine, the assembly comprising: a cutting mechanism including a motorized rotary blade which is configured to traverse a path across a conveyor belt of the liner application machine; a stopping mechanism, located at a terminal end of the path, the stopping mechanism detecting if the cutting mechanism is present at the terminal end; and a computer controller configured to control the liner application machine; wherein, when a cutting event occurs the controller first stops motion of an insulative thermal blanket through the liner application machine; secondly, the cutting mechanism traverses the path until the stopping mechanism detects the cutting mechanism; and thirdly, the controller restarts motion of the insulative thermal blanket through the liner application machine.

In an embodiment, the assembly further comprises a second stopping mechanism located at a second terminal end of the path.

In an embodiment of the assembly, the path comprises the cutting mechanism crossing the conveyor belt only a single time.

In an embodiment of the assembly, the path comprises the cutting mechanism crossing the conveyor belt multiple times which may comprise crossing once in a first direction and once in a reverse direction.

In an embodiment of the assembly, the assembly is positioned after a drive roller for the conveyor belt.

DETAILED DESCRIPTION OF THE PREFERRED EMBODIMENT(S)

There is described herein an insulation cutter for a liner application machine in an assembly line that cuts the insulation by stopping the liner application machine momentarily to allow for a rotary cutter to traverse the width of the belt (and the width of the thermal insulation blanket) and potentially return back to its original position. The machine is then restarted and allowed to continue to feed.

When referred to herein it should be understood that the term insulative thermal blanket, which is the product being cut by the machine, includes insulative thermal blankets with a thermally reflective surface and insulative thermal blankets without a thermally reflective surface. However, the systems and methods discussed herein are principally used when the insulative thermal blanket includes a thermally reflective surface as these pose a more difficult challenge for conventional swing-arm and chop cutting machines.

Figure 1:
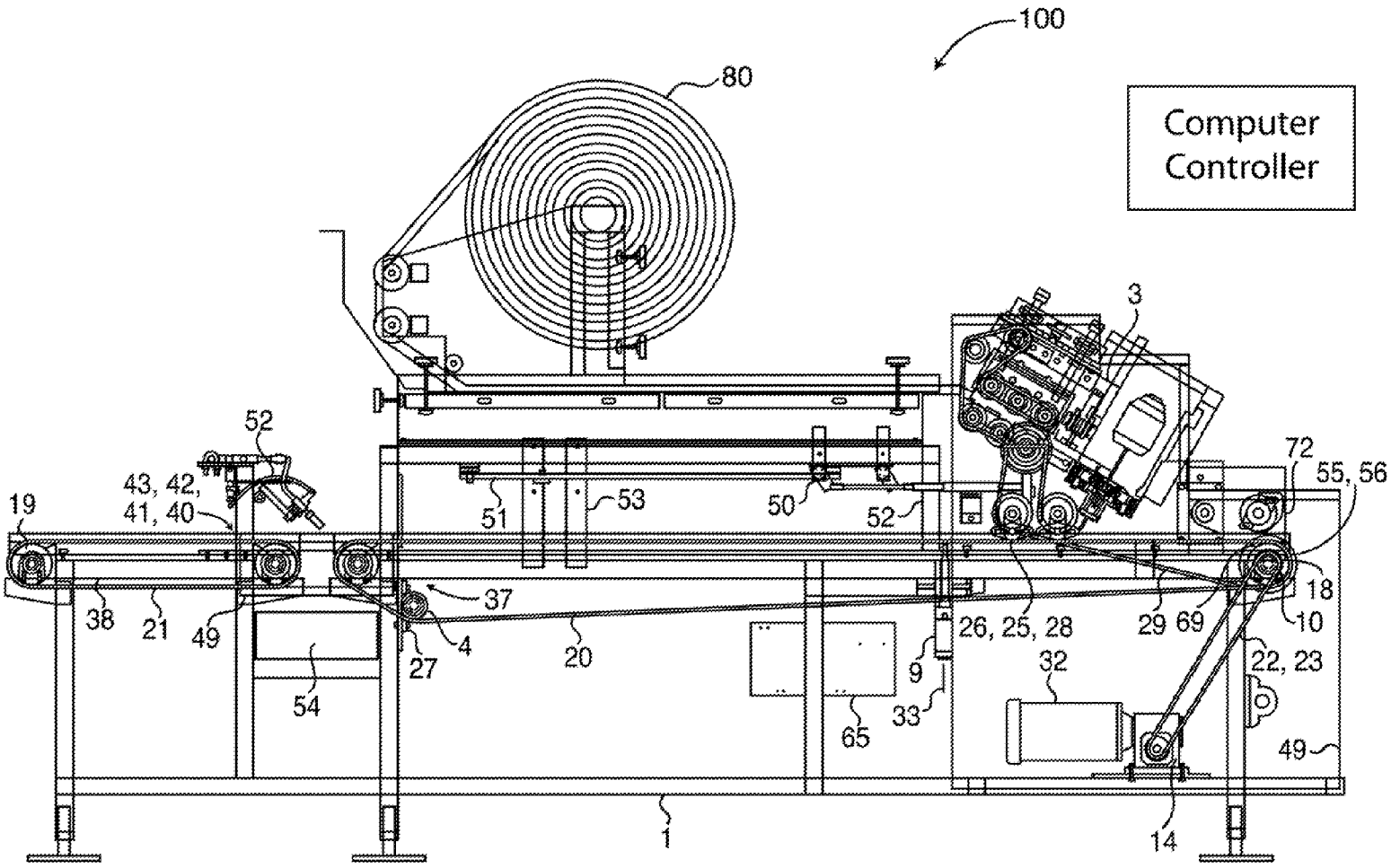
FIG. 1 provides a side assembly view of a liner application machine in an assembly line system.

The device (100) as described herein is contemplated for use with any pinner conveyor assembly line system with a liner application machine (or other similar system known to those of ordinary skill in the art) for the production of sheet ductwork with a thermal insulation blanket attached thereto. In one embodiment, this liner application machine in the assembly line system is of generally known construction and will generally appear as depicted in FIG. 1. The device depicted in FIG. 1 includes a frame (1); an insulation cradle assembly (2); a take-up roll assembly (4); a squaring pin assembly (9); a drive shaft (conveyor pulley) (10); a leeson reducer (14); a variable pitch sheave (18); pillow block bearing (19); a belt (20 and 21); a single riveted chain (22); a chain connecting link (23); a drive tightener (25); a tightener shaft (26); pillow block bearing (27); a v-belt flat face idler pulley (28); a v-belt (29); an inverter duty motor (32); an adhesive assembly (40); a glue manifold (41); an air manifold (42); a pneumatic/adhesive schematic (43); a chain guard assembly drive (49); an adjusting sensor mount assembly insulation shear (50); a sensor mount bracket (51); sensor mount bracket glue tips and feed rolls (52); a mount strap duct liner pump (53); a drain pan (54); sprockets (55 and 56); a mount plate with air valves (65); an adjusting stop block (69); and a guard driven stilson roll shaft (72). These components are generally of conventional construction and are well understood by those of ordinary skill in the art.

The device (100) also includes a shear assembly (3). In a conventional machine, this shear assembly might comprise a chop or swing-blade mechanism, or may not be present at all. However, in the device of FIG. 1, the shear assembly (3) is designed to utilize a rotary blade cutter (106). In general, the shear assembly (3) disclosed herein will generally be located on the portion of the liner application machine (100) just prior to where the insulation comes into contact with the metal ductwork sheeting. Stated differently, the shear assembly (3) is generally located in a position, as depicted in FIG. 1, where the insulation is cut prior to becoming glued, nailed or otherwise attached to the ductwork metal sheeting.

Figure 2A:
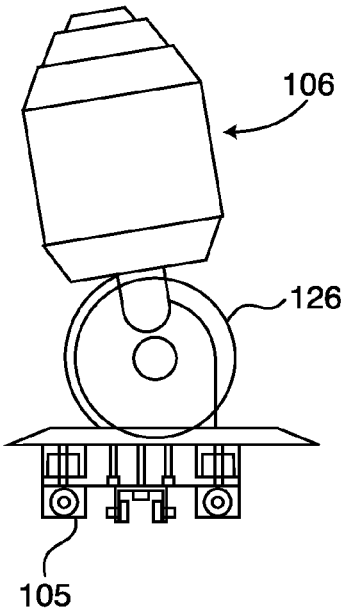
FIG. 2A provides a front view of an embodiment of the shear assembly in which the cutting mechanism is a rotary blade.
Figure 2B:
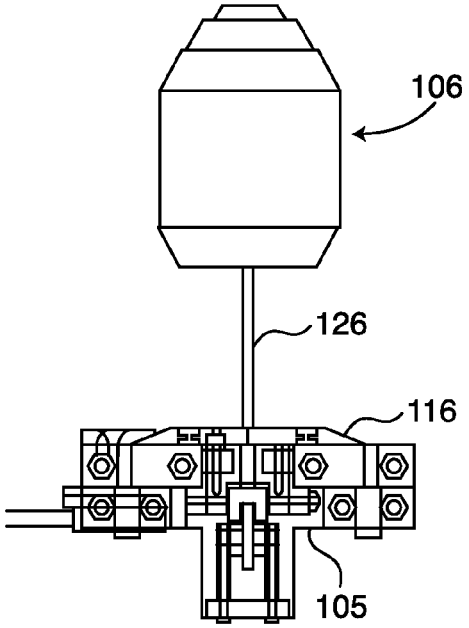
FIG. 2B provides a side view of an embodiment of the shear assembly in which the cutting mechanism is a rotary blade FIG. 2C provides a top view of a pressure switch.

As noted previously, in one embodiment, the cutting mechanism (106) in the shear assembly (3) described herein is a rotary blade (126) known to those of ordinary skill in the art for cutting fiberglass, elastomeric, plastic or other materials known to be utilized to construct thermal insulating blankets. However, any cutting mechanism that is capable of traversing the span of the conveyor belt carrying the material and adequately cutting the insulative thermal blanket is contemplated in this application. In the embodiments described herein, it is contemplated that the cutting mechanism (106) will be motor-powered with the rotary blade (126) not simply rotating due to linear traversal, but having a motor which actively turns the blade. FIG. 2A provides a front view and FIG. 2B a side view of an embodiment of the shear assembly (3) in which the cutting mechanism (106) includes a powered rotary blade (126).

The rotary blade (126) will generally be positioned either in close proximity to, or in contact with a cutting deck upon which the blade rolls in order to keep it from having significant wobble. The pinching action of the rotary blade (126) and the deck may also provide the cutting action. Alternatively or additionally, the cutting mechanism (106) may include a tongue (116) through which the rotary blade (126) passes at least part way. The tongue (116) may be positioned so as to always be at least partially underneath the insulative thermal blanket (80) or may lift the blanket (80) onto itself at the initiation of the cutting action. When the cutting action occurs, the tongue (116) can pass under the blanket (80) with the blade (126) being located primarily above the blanket (80) and the pinching action of the blade (126) and tongue (116) providing the cutting action.

Figure 3:
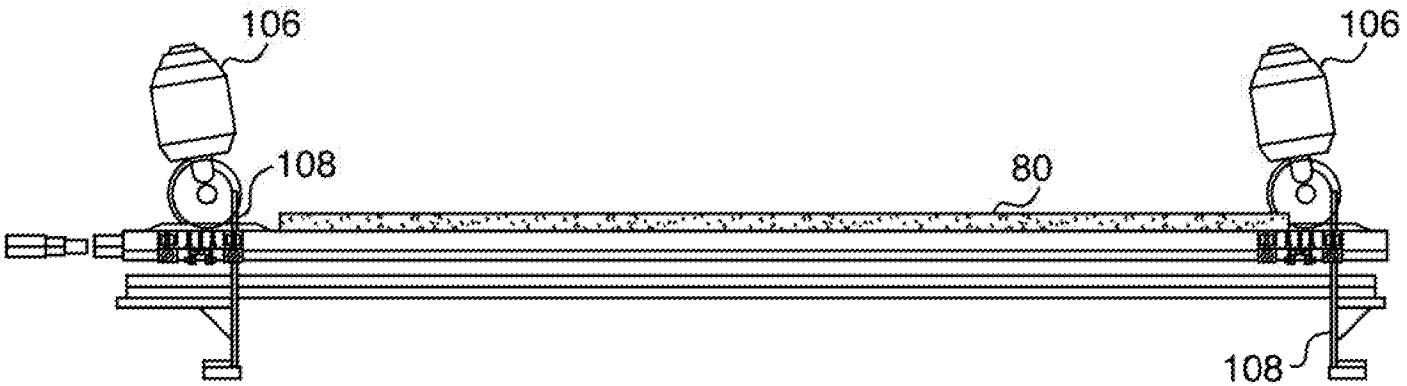
FIG. 3 provides a front view of the cutting mechanism on its path of travel across the belt of the liner application machine.

Further, FIG. 3 provides a front view of the cutting mechanism (106) on its path of travel across the belts of the liner application machine of the assembly line system. In the depicted embodiment, the path of travel of the rotary blade (106) is about 64 inches in each pass, or 128 inches per cutting event and the cutting mechanism is depicted in its two extreme or terminal positions. It should be recognized however that these distances are not determinative and that any length pass necessary to cut the insulative thermal blanket is contemplated. In one embodiment, the traversal of the cutting mechanism (106) on its path of travel across the belt as shown in FIG. 3 is powered by an air operated cable cylinder. Generally, when utilized, this air operated cable cylinder will be attached to the tracking mechanism (105) of the cutting mechanism (106) which can provide location information about the location of the cutting mechanism (105) and/or insure it is following the predefined path. It should be understood, however, that any method of powering the traversal of the cutting mechanism (106) during a cutting event known to those of ordinary skill in the art is contemplated including, but not limited to, an electric gear motor arrangement with chain and sprockets.

A cutting event of the shear assembly mechanism (3) described herein occurs when the cutting mechanism (106) completes any number of passes from its starting position on one side of the belt to the other side of the belt and/or back again. Thus a single cutting event may occur when the cutting mechanism makes a pass from its starting position on one side of the belt to the other side of the belt and back again to its original position—i.e., an "around-the-world" trip from one side of the belt to the opposite side and back again, a single pass from the starting position to the other side, a single pass from the other side back to the starting position, or any combination of these. Generally, it is contemplated that this cutting event, whether in the embodiment where it comprises a single pass or a multiple number of passes, will occur at a fast pace (i.e., in a matter of seconds).

In certain embodiments, it is contemplated that the cutting event will be controlled by computer operated software for automating such systems as known to those of ordinary skill in the art. In other embodiments, it is contemplated that the cutting event will be controlled manually, through an operator triggering a cutting event through a switch or other activation methodology known to those of ordinary skill in the art. Generally, it is contemplated that a cutting event will occur in an automated manner such that the thermal insulative blanket is cut at a point in time on the liner application machine of the assembly line such that the insulative layer will be cut in time to come into contact and be adhered to the corresponding piece of ductwork on the assembly line whose dimensions it is cut to match.

In addition to the cutting mechanism (106), it is contemplated that, in certain embodiments, the shear assembly (3) also comprises a moveable tracking mechanism (105) known to those of ordinary skill in the art. Generally any tracking mechanism (105) that is capable of moving the cutting mechanism (106) from one side of the liner application machine to the other side of the liner application machine is contemplated in this application. As seen in FIG. 3, in one embodiment, a stopping mechanism (108) or baton or other shock absorbing mechanism known to those of ordinary skill in the art will be located at each end of the path of the cutting mechanism (106). This stopping mechanism (108) will act to signal a terminating end of the cutting path of the cutting mechanism (106) during a cutting event.

Figure 2C:
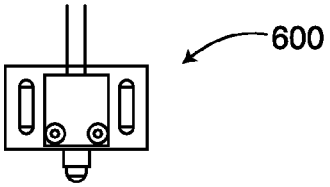

In another embodiment, as seen in FIG. 3, a switch (600) or other trigger or sensor mechanism known to those of ordinary skill in the art will be located at each end of the path of the cutting mechanism (106). This switch (600) will act to signal a terminating end of the cutting path of the cutting mechanism (106) during a cutting event. One embodiment of a pressure switch (600) is shown in FIG. 2C and it may be positioned so as to contact any part of the cutting mechanism (106) when the cutting mechanism is at the extreme positions of FIG. 3. While, a pressure switch is a simple and robust system which can be used to detect when the cutting mechanism (106) is at the extremes of position, alternative switches, sensors, and detectors, may be used in alternative embodiments as would be understood by one of ordinary skill in the art.

Notably, it is contemplated that the liner application machine will stop momentarily during a cutting event. Generally, the stoppage of the liner application machine will be only long enough for a complete traversal of the cutting mechanism (106)—one complete "cutting event"—to occur. This stopping of the liner application machine is antithetical to the prevailing status quo in the art. First, it used to be impossible to stop the liner application machine of the assembly line during production. Second, generally, to one of ordinary skill in the art, it would not have been logical to stop a liner application machine to allow a cutting event to occur as this could slow down and otherwise falter the assembly process.

In practice, it is contemplated that the shear assembly (3) mechanism disclosed herein will operate as follows. First, a roll of insulative thermal blanket (80), such as those known to those of ordinary skill in the art, will be placed on the liner application machine (100) and will travel down a liner application machine (100) of an assembly line known to those of ordinary skill in the art through the action of drive rollers or related systems. A piece of metal ductwork, to which the a piece of insulative thermal blanket (80) is to be attached, will also enter the machine (100) and be moved by drive rollers or similar systems.

As noted previously, the shear assembly (3) will generally be located on the liner application machine (100) of the assembly line at a location after the drive rollers but before the insulative thermal blanket (80) is connected to the metal ductwork. Thus, the two pieces are separate at the time of cutting. At a time to be determined by the operator of the assembly line (either through operating software or manually triggered by an operator), a cutting event will occur to cut the insulative thermal blanket (80) to the desired dimensions. Specifically, to cut-off the roll. When a cutting event is triggered, generally by the end of a piece of the metal ductwork to which the insulative thermal blanket (80) is to be attached will be at a specific point which may be detectable by the device (100) and the detection of which may trigger the cutting event.

Upon the cutting event being triggered, the liner application machine (100) stops. Specifically, at least the insulative thermal blanket (80) feed is halted. However, in other contemplated embodiments, both the ductwork and insulative thermal blanket (80) feeds are simultaneously stopped such as by halting the motion of all the drive rollers. It should be apparent that this may be accomplished by cutting power to the machine, or by simply stopping a universal motor which is turning both drive rollers via a common driveshaft among other options.

After the motion of the insulative thermal blanket (80) is halted, the cutting mechanism (106) will traverse one length of the belt to the point where it comes into contact with the stopping mechanism (108) (e.g. switch (600) or other device depending on the embodiment) located on the side of the belt opposite the starting point of the cutting mechanism (106). At this time in the cutting event, the cutting mechanism (106) will have travelled through the insulative thermal blanket (80) in one pass, cutting the insulative thermal blanket (80) at the stopped location. After the cut is complete, the insulation cutting machine (100) may then reactivate the stopped drive rollers and continue the process of applying and nailing (pinning) the insulation (80) to the mating sheet.

Alternatively, the cutting mechanism (106), after coming into contact with the stopping mechanism (108) on the opposite side of the belt from the starting point, re-traverses the original path, returning to the opposite side of the belt and stopping when it comes into contact with a second stopping mechanism (108) or switch (600) (depending on the embodiment) located at its original starting location. In other words, the cutting mechanism (106) crosses the belt and returns to its home location (a full circuit), in the single cutting event. In some embodiments it is contemplated that in this second pass, the cutting mechanism (106) again travels through the same cutting line the cutting mechanism (106) created in the original pass.

Thus, in certain contemplated embodiments, in this second pass the cutting mechanism (106) is able to cut any remaining fibers or other material components of the insulative thermal blanket (80) that might still be connected to each other, thus creating a clear, unobstructed cut along the entire width of the insulative thermal blanket (80). In other embodiments, this second pass does not constitute a cutting event and only serves the function of returning the cutting mechanism to its original starting location for the next cutting event. Still further, the second pass may comprise either of these events based on how well the cut was made and for certain cuts within a roll of insulative thermal blanket (80) the second pass may sometimes further cut and other times simply return the cutting mechanism (106) to its starting point. In certain embodiments, it is contemplated that this complete process should only take a matter of seconds.

It should be understood that, while cutting events comprised of only one traverse or two or more traverses of the belt (or one round-trip traverse) are described in detail in this application, any number of passes that are deemed necessary by the assembly line operator to create a clean and precise cut are contemplated as constituting a programmable and contemplated "cutting event." For example, a "cutting event" can constitute a single traverse or any multiple number of traverses.

Regardless of how many passes are made, once the cutting event is deemed complete, the completion may be detected by operating software or the operator and the stopped feeds (insulative thermal blanket (80) and/or insulative thermal blanket and ductwork) are simultaneously restarted. The completion of a cutting event may occur either because a fixed number of passes has been completed regardless of the effectiveness of the cutting event, or a sensor or other device may be used that determines that the insulative thermal blanket (80) is sufficiently cut to allow the process to continue. It is important to note that in a preferred embodiment during a cutting event, the liner application machine and nailer are temporarily halted. This "stutter" in the line will generally result in minimal delay and maintaining the correct assembly pattern for all pieces of ductwork in the assembly line. In effect, the precision and completeness of the cut made can provide a greater benefit than the loss of time from having to "stutter" the assembly line.

The shear assembly (3) disclosed herein is an advance over the other thermal insulative blanket cutting systems utilized in the art because it is automated, precise, can be used in a liner application machine (100) in an assembly line and, importantly, can adequately and completely cut through newer elastomeric insulative thermal blanket products with a radiant layer such as PolyArmor®, which products could not be adequately cut by the cutting mechanisms of the prior art.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A method for cutting an insulative thermal blanket during assembly of lined ductwork, the method comprising:

providing a liner application machine for joining an insulative thermal blanket to a piece of metal ductwork, the machine including:

a frame;

a conveyor belt disposed on said frame;

a shear assembly located on said frame, said shear assembly including:

a cutting mechanism including a motorized rotary blade which is configured to traverse a path across said conveyor belt;

a stopping mechanism, located at a terminal end of said path, said stopping mechanism detecting if said cutting mechanism is present at said terminal end by said cutting mechanism contacting said stopping mechanism; and a computer controller;

moving said insulative thermal blanket through said liner application machine;

moving said metal ductwork through said liner application machine;

said computer controller stopping motion of said insulative thermal blanket through said liner application machine;

after said motion is stopped, cutting said insulative thermal blanket with said cutting mechanism by said cutting mechanism traversing said path until said cutting mechanism is stopped by said stopping mechanism; and after said insulative thermal blanket is cut, said computer controller restarting motion of said insulative thermal blanket through said liner application machine.

2. The method of claim 1 wherein:

when said computer controller stops motion of said insulative thermal blanket through said liner application machine, said computer controller also stops motion of said piece of metal ductwork through said liner application machine; and when said computer controller restarts motion of said insulative thermal blanket through said liner application machine, said computer controller also restarts motion of said piece of metal ductwork through said liner application machine.

3. The method of claim 1, wherein said cutting said insulative thermal blanket with said cutting mechanism comprises: said cutting mechanism crossing said conveyor belt only a single time.

4. The method of claim 1, wherein said cutting said insulative thermal blanket with said cutting mechanism comprises: said cutting mechanism crossing said conveyor belt multiple times.

5. The method of claim 4, wherein said multiple times comprises crossing once in a first direction and once in a reverse direction.

* * * * *